United States Patent [19]

Cottam

[11] 4,322,262

[45] Mar. 30, 1982

[54] APPARATUS FOR WRAPPING CONDUITS WITH SHEET MATERIAL

[75] Inventor: Spencer D. Cottam, Houston, Tex.

[73] Assignee: T. C. Mfg. Co., Inc., Evanston, Ill.

[21] Appl. No.: 126,367

[22] Filed: Mar. 3, 1980

[51] Int. Cl.[3] ..... B65H 81/00

[52] U.S. Cl. ..... 156/392; 156/427; 156/428; 156/468; 156/497; 156/498; 156/584

[58] Field of Search ..... 156/392, 468, 498, 523, 156/584, 425, 428, 497; 118/307, 208, 207, 305; 242/68 R, 68.4

[56] References Cited

U.S. PATENT DOCUMENTS

| | | | |
|---|---|---|---|
| 1,502,218 | 7/1924 | Van Hook | 242/68.4 |
| 2,057,061 | 10/1936 | Eggerss | 156/468 |
| 2,770,284 | 11/1956 | Myrick | 156/392 |
| 3,470,057 | 9/1969 | Stuart et al. | 156/392 |
| 4,005,677 | 2/1977 | Hart | 118/307 |
| 4,058,427 | 11/1977 | Wilson | 156/392 |
| 4,069,088 | 1/1978 | Cottam | 156/392 |

*Primary Examiner*—David A. Simmons
*Attorney, Agent, or Firm*—Mason, Kolehmainen, Rathburn & Wyss

[57] ABSTRACT

Apparatus is disclosed capable of wrapping both cold-applied and hot-applied strips of sheet material in tape form around a pipe or conduit having a generally circular cross-sectional external shape. The apparatus includes a frame having a desired number of frame cross members for structural support and having a hinged rotatable frame portion; a plurality of guide roller assemblies connected to the frame; a guide roller tensioning assembly; a sheet material feeding assembly; a sheet material tensioning assembly; a guide roller angular adjustment assembly, adjustable to vary the angle of the guide rollers with respect to the conduit being wrapped for varying the amount of sheet material overlap; a cold-applied tape backing material take off and wrapping assembly, and a burner assembly, alternatively attachable to the frame instead of the cold-applied tape backing material take off and wrapping assembly, when hot applied tape is used.

36 Claims, 14 Drawing Figures

FIG. 3
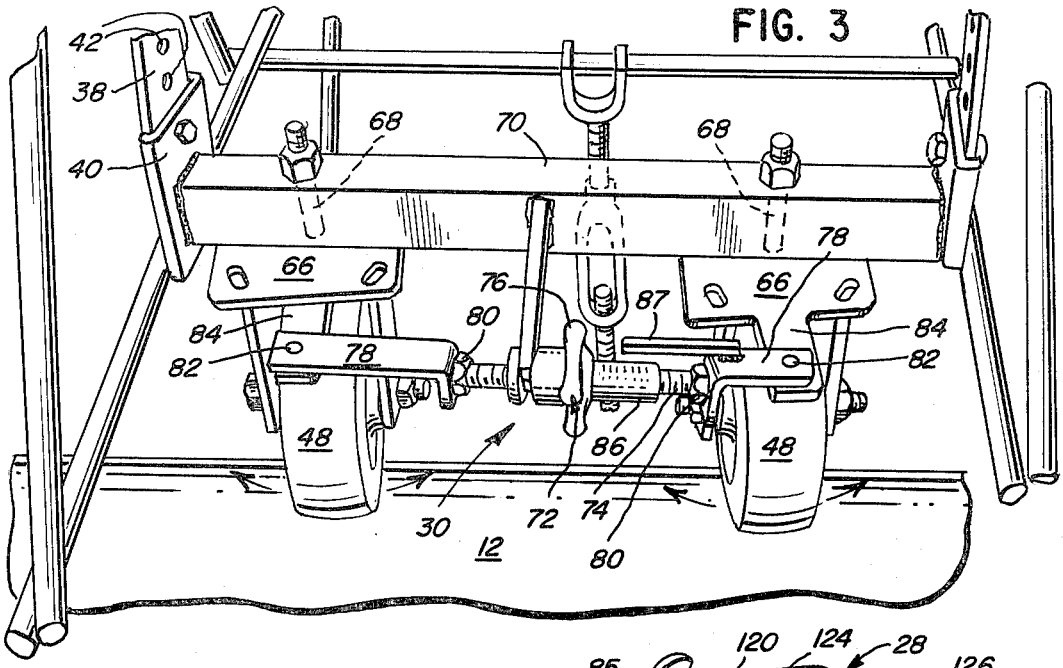
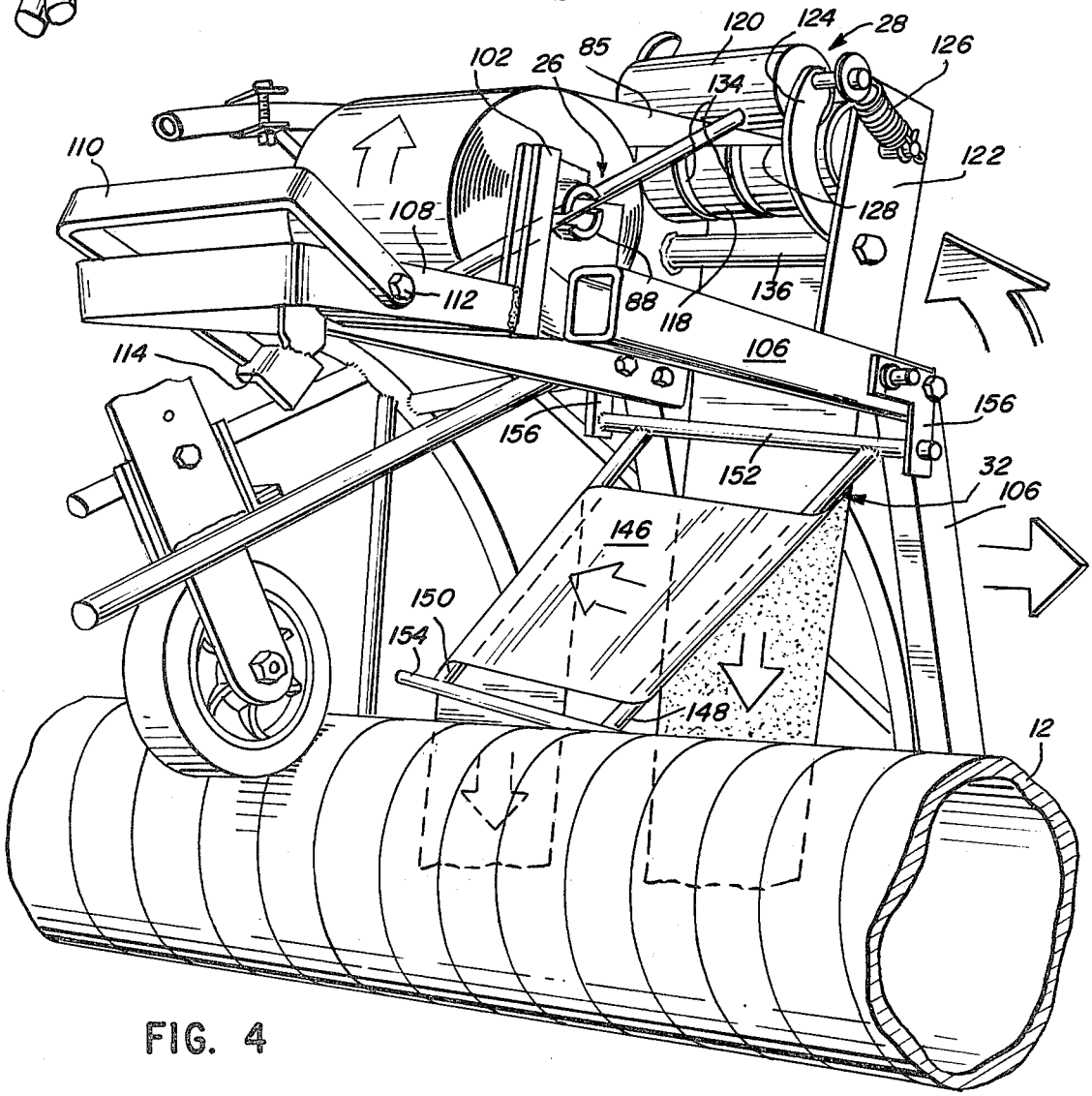
FIG. 4

APPARATUS FOR WRAPPING CONDUITS WITH SHEET MATERIAL

FIELD OF THE INVENTION

The present invention relates to an apparatus capable of wrapping both cold-applied and hot-applied strips of sheet material in tape form around a pipe or conduit having a generally circular cross-sectional external shape. More particularly, the present invention relates to a pipe or conduit wrapping device capable of helically wrapping a protective strip of tape around elongated conduits of various diameters with a predetermined and consistent amount of tape overlap under consistent tape tension to achieve efficient and complete tape adherence and exceptional corrosion resistance.

BACKGROUND OF THE INVENTION

Prior Art

A Stuart et al U.S. Pat. No. 3,470,057 discloses a pipe wrapping machine having a generally U-shaped frame for wrapping a pipe with a hot-applied tape. The apparatus disclosed in the Stuart et al patent includes an arm-lock assembly having wheels to retain the machine on the pipe in a rotatable manner. Pressure is applied against the pipe by the wheels of the arm-lock assembly to hold the machine against the pipe by adjustably disposing two sets of wheels in appropriate slots in the frame member and by spring biasing a third set of wheels inwardly toward the pipe across a mouth of the frame to resiliently secure the conduit between the three sets of wheels. Difficulties have been encountered in achieving consistent tape wrapping under constant tension with the apparatus shown in the Stuart patent. It has been found by applicant that one of the problems with the Stuart et al apparatus results from the resiliently attached third set of wheels not maintaining a constant pressure against the pipe during rotation of the apparatus. Because of the weight of the Stuart et al apparatus, the spring biasing force against the pipe is substantially changed as the apparatus is helically rotated around the pipe, particularly when the spring biased wheels are disposed on the top surface of the pipe, causing inconsistently applied pressure against the pipe from the various apparatus supporting wheels, at various rotational dispositions of the apparatus on the pipe. The tape, therefore, is not consistently applied under precise tension around the outer surface of the pipe and may cause inconsistent tape adherence.

Further, the Stuart et al apparatus suffers from various inconsistencies in angular alignment of the tension applying wheels and has no apparent provision for precisely fixing the angular disposition of the apparatus support wheels or the tape feeding assembly for fixing a desired degree of tape overlap without tape distortion, such as stretching.

SUMMARY OF THE INVENTION

The apparatus of the present invention overcomes the above mentioned and other deficiencies of the Stuart et al apparatus by providing a rotatable frame member portion capable of being freely rotated toward and away from the conduit to permit the apparatus initially to be disposed in proper position around the conduit and for maintaining the apparatus in secure position around the conduit so that no portion of the frame member can move with respect to the remainder of the frame member during the helical rotation of the apparatus around the conduit. Other new and important improvements over the apparatus disclosed in the Stuart et al patent are disclosed in detail herein.

In brief, the apparatus of the present invention includes a frame including a desired number of frame cross members for structural support and having a hinged rotatable frame portion; a plurality of guide roller assemblies connected to the frame; a guide roller tensioning assembly; a sheet material feeding assembly; a sheet material tensioning assembly; a guide roller angular adjustment assembly adjustable to vary the angle of the guide rollers with respect to the conduit being wrapped for varying the amount of sheet material overlap; a cold-applied tape backing material take off and wrapping assembly; and a burner assembly, alternatively attachable to the frame instead of the cold-applied tape backing material take off and wrapping assembly, when hot applied tape is used.

Accordingly, an object of the present invention is to provide new and improved apparatus for wrapping a conduit with a strip of sheet material.

Another object of the present invention is to provide new and improved apparatus for wrapping a conduit with a strip of sheet material including a frame having a rotatable frame portion so that a section of the frame can be angularly rotated in directions toward and away from the conduit. The apparatus can be positioned to envelop the conduit when the rotatable frame portion is moved away from the conduit and the conduit is adjustably and fixedly secured within the enveloping frame member when the rotatable frame portion is angularly rotated inwardly toward the conduit.

Another object of the present invention is to provide new and improved apparatus for wrapping a conduit with a strip of sheet material in tape form including a plurality of frame supported wheels or pressure rollers securing the apparatus of the present invention around the conduit in a non-resilient, rotatable manner.

Another object of the present invention is to provide new and improved apparatus for wrapping a conduit with a strip of tape material including a rotatably releasable frame portion including a tape-contacting guide wheel assembly extending inwardly from the releasable frame portion and including an adjustable guide roller tensioning assembly connected to both the releasable frame portion and the remainder of the apparatus frame for positioning a plurality of guide wheel assemblies against an outer surface of the conduit under a desired degree of pressure.

Another object of the present invention is to provide new and improved apparatus for wrapping a conduit with a strip of sheet material including a guide roller angular adjustment assembly for adjustably disposing frame carried guide rollers angularly with respect to the longitudinal axis of the conduit being wrapped.

Another object of the present invention is to provide new and improved apparatus for wrapping a conduit with a strip of sheet material including a sheet material feeding assembly and a sheet material tensioning assembly both angularly adjustable automatically with a single angular adjustment made to a guide roller angular adjustment assembly.

Another object of the present invention is to provide new and improved apparatus for wrapping a conduit with a strip of tape material including means for simultaneously angularly adjusting a plurality of guide rollers simultaneously at the same angle with respect to the conduit being wrapped.

Another object of the present invention is to provide new and improved apparatus for wrapping a conduit with a strip of sheet material in tape form including a sheet material tensioning assembly for feeding the strip material to the conduit under adjustable tension by passing the strip material through a pressure nip having an adjustable braking assembly for adjusting the desired amount of tape tension as the tape is fed to a tape applying pressure roller.

Another object of the present invention is to provide a new and improved apparatus for wrapping a conduit with a strip of sheet material in tape form including a new and improved locking mechanism for securing a roll of tape to the frame of the apparatus of the present invention in a rotatable manner while locking the roll of tape securely to the frame.

Another object of the present invention is to provide new and improved apparatus for wrapping cold-applied tape over an exterior surface of a conduit including a new and improved tape backing material take-off and wrapping assembly for overcoating the applied tape with the strip of tape backing material removed from the tape as the tape is applied to the conduit.

Another object of the present invention is to provide a sheet material feeding assembly including a new and improved mechanism for releasably maintaining a roll of sheet material on a material feed reel.

Another object of the present invention is to provide a sheet material feeding assembly including a new and improved feed reel locking assembly for connecting a material feed reel securely to the frame of the material wrapping apparatus during its helical travel path around a conduit.

Another object of the present invention is to provide a new and improved burner valving assembly actuatably interconnected to a braking mechanism on a guide roller such that rotation of the guide roller in a direction required for hot-applied tape wrapping opens a burner valve to permit a combustible fluid to be delivered to a burner assembly, and slight rotation of the guide roller in the reverse direction closes the burner valve. In accordance with another object, a burner valve by-pass pilot conduit is provided to maintain a constant, small flow of combustible fluid to the burner assembly to maintain a pilot flame whether the burner valve is on or off.

BRIEF DESCRIPTION OF THE DRAWINGS

For a better understanding of the present invention reference should be had to the following detailed description taken in conjunction with the drawings, in which:

FIG. 3 is a partially broken-away, elevational view of a guide roller angular deflection assembly portion of the apparatus constructed in accordance with the principles of the present invention;

FIG. 4 is a partially broken-away perspective view of a portion of the apparatus constructed in accordance with the principles of the present invention;

DETAILED DESCRIPTION OF A PREFERRED EMBODIMENT

Figure 1:
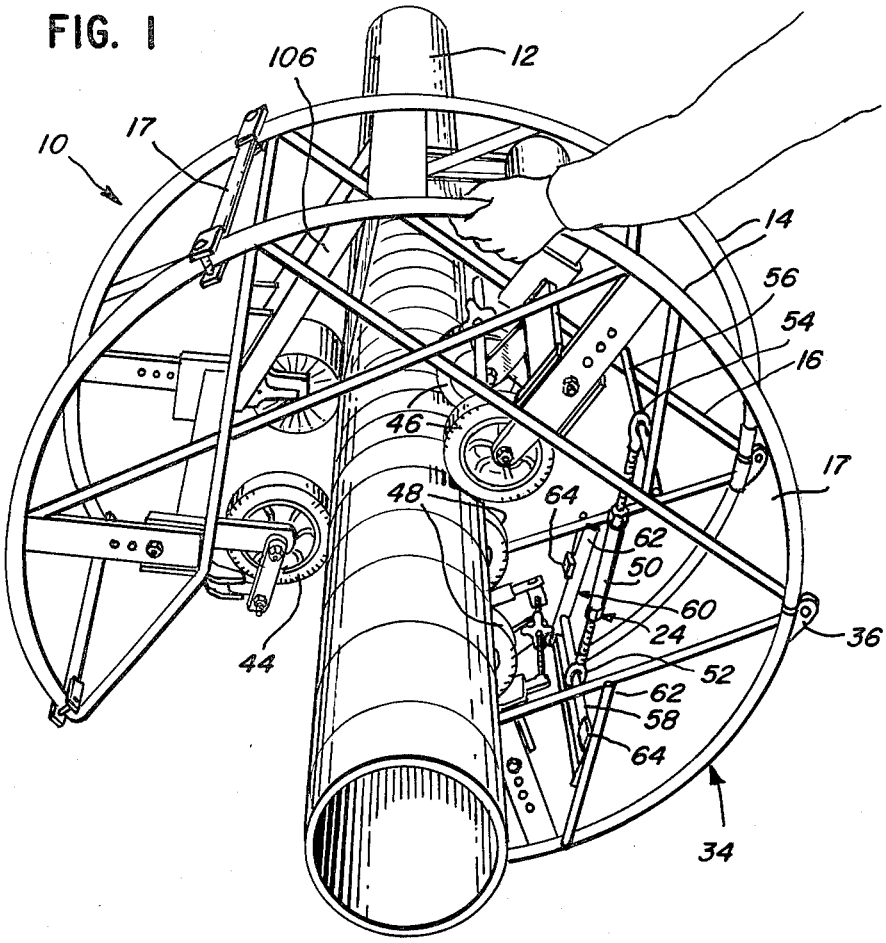
FIG. 1 is a perspective view of a new and improved apparatus for wrapping a conduit with a strip of sheet material, shown rotatably secured to a conduit during tape wrapping.

Referring now to the drawings, and initially to FIG. 1, there is illustrated a new and improved device, generally designated by reference numeral 10, for wrapping a conduit 12, having a generally circular cross section with sheet material in tape form. The apparatus of the present invention includes a frame member, generally designated by numeral 14, including a desired number of internal frame cross members 16 for structural support; a plurality of exterior frame cross members 17 for manual rotation of the frame assembly helically around conduit 12; a plurality of guide roller assemblies 18, 20, and 22 (FIG. 2); a guide roller tensioning assembly, generally designated by numeral 24; a sheet material feeding assembly 26; a sheet material tensioning assembly 28 (FIG. 4) a guide roller angular adjustment assembly 30, and a cold-applied tape backing material take off and wrapping assembly 32 (FIG. 4). The frame 14 includes a rotatable frame portion generally designated by reference numeral 34, as shown in both solid and broken lines in FIG. 12, adapted to be rotated about hinges 36 outwardly away from and inwardly toward conduit 12, as shown in FIG. 12.

Angularly rotatable frame portion 34 has a guide roller assembly 22 attached thereto. The guide roller assembly 22 is connected by securing guide roller extension members 40 to the guide roller support member 38 by a pin or bolt 41 projecting through one of the apertures 42 in the guide rollers support members 38 and guide roller extension members 40, as shown in FIG. 12. Accordingly, the rotatable frame portion 34 can be rotated outwardly away from conduit 12 about hinges 36 so that the apparatus initially can be positioned around the conduit 12 when the rotatable frame portion is in the position shown in solid lines in FIG. 12. Once the guide roller assemblies 18 and 20 make contact with the conduit 12 through rollers or wheels 44 and 46, the rotatable frame portion 34 is swung inwardly toward conduit 12 until the roller 48 of guide roller assembly 22 also makes contact against an outer surface of conduit 12, as shown in broken lines in FIG. 12, to secure the apparatus around conduit 12.

In accordance with an important feature of the present invention, the guide roller assemblies 18, 20 and 22 are adjustably held against an outer surface of conduit 12 under constant and non-resilient pressure so that the sheet material is wrapped around the conduit under constant tension, thereby securing the sheet material strongly and consistently over the entire external surface of conduit 12. The constant pressure applied by guide roller assemblies 18, 20, and 22 to the external surface of conduit 12 is achieved by the guide roller tensioning assembly 24.

Figure 2:
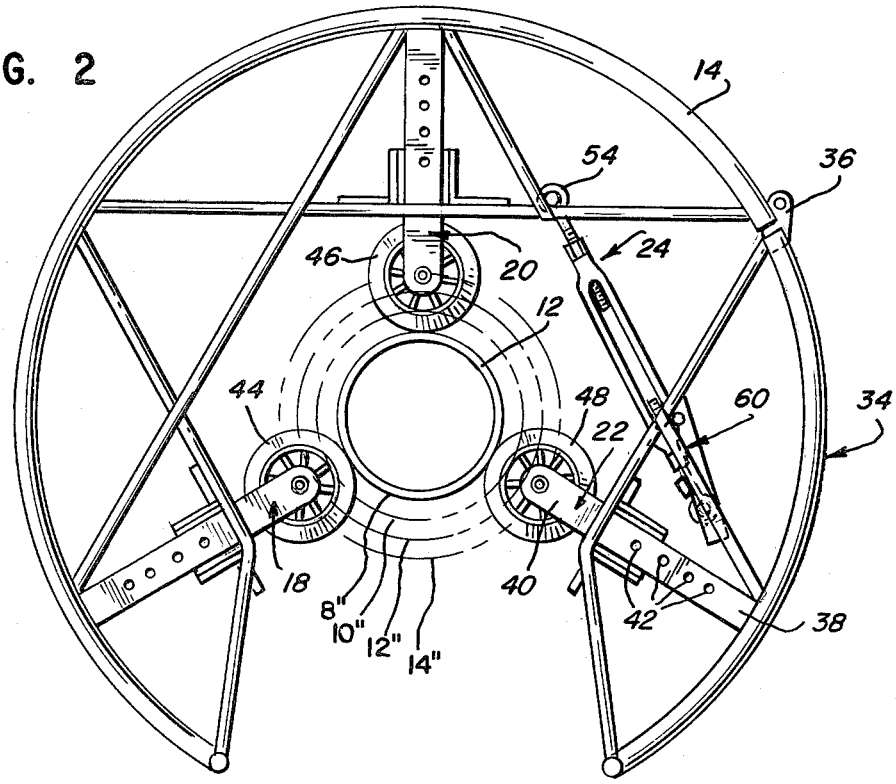
FIG. 2 is a side elevational view of the apparatus of FIG. 1.
Figure 12:
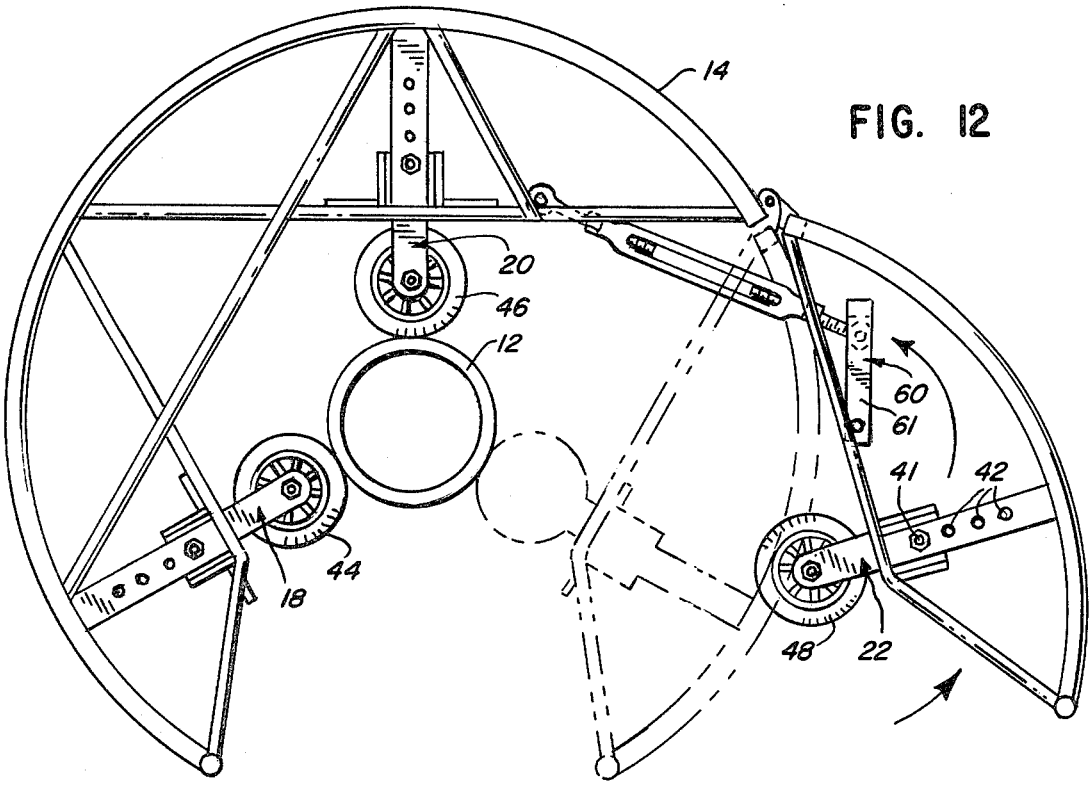
FIG. 12 is a side view of the frame constructed in accordance with the principles of the present invention showing the angularly rotatable frame portion opened in solid lines for initially disposing the frame member around a conduit, and showing the angularly rotatable frame portion in broken lines for rotatably but fixedly securing the frame, under pressure, against the conduit.

The guide roller tensioning assembly 24 shown in FIGS. 1, 2, and 12 includes a turnbuckle 50 connected at one end 52 to the rotatable frame portion 34 and connected at the other end 54 to a cross member 56 of the remainder of the frame 14. By tightening turnbuckle 50, rotatable frame portion 34 will be rotated inwardly about hinges 36 toward the conduit 12 thereby forcing guide rollers 48 of guide roller assembly 22 against the outer surface of conduit 12, as shown in broken lines in FIG. 12. Further tightening of turnbuckle 50 provides a desired amount of constant pressure of guide rollers 44, 46 and 48 against the outer surface of conduit 12 to achieve a constant, non-resilient pressure against the sheet material as it is applied to the outer surface of conduit 12.

As best shown in FIGS. 1 and 12, end 52 of turnbuckle 50 is connected to a cross member 58 of a turnbuckle quick release mechanism generally designated by numeral 60, which locks the turnbuckle 50 in a predetermined state of tension to pull the angularly rotatable frame portion angularly toward conduit 12, as shown in FIG. 1. The quick release mechanism 60 is locked in place by rotating a U-shaped quick release handle 61 about pivot pins 62 (FIG. 1) until the quick release handle 61 hits stop members 64. In this manner, the turnbuckle 50 can be tensioned to a predetermined degree for a particular diameter conduit 12 so that the rotatable frame portion 34 can be quickly released from, or secured against the conduit 12 with a desired degree of tension by rotating quick release handle 61 outwardly away from stops 64 or inwardly against stops 64, respectively, as shown in FIGS. 1 and 12.

Figure 6:
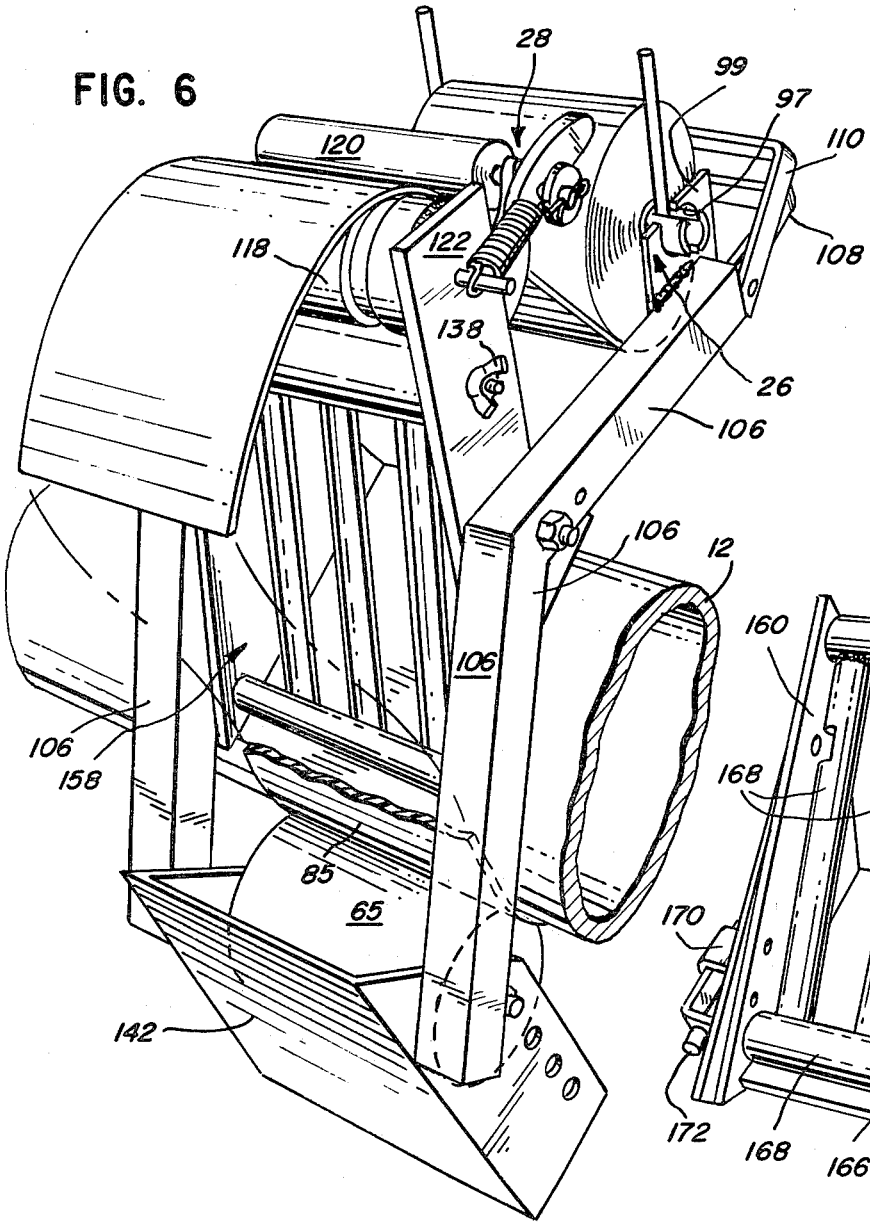
FIG. 6 is a partially broken-away, perspective view of a portion of the apparatus of the present invention constructed in accordance with the principles of the present invention.

The guide roller assemblies 18, 20 and 22 each include guide roller angular adjustment assemblies, generally designated by numeral 30, and best shown in FIG. 3. The guide roller angular adjustment assemblies 30 will be described with reference to guide roller assembly 22 only, but it is to be understood that the guide roller angular adjustment assemblies for guide roller assemblies 18 and 20 are constructed in the same manner except for a difference in the roller housing for roller assembly 18, as shown in FIG. 6, to accommodate enlarged strip material-applying pressure roller 65. The guide roller angular adjustment assembly 30 of guide roller assembly 22, as shown in FIG. 3, generally includes pivotable roller housings 66 rotatably secured at one end to an axle of wheels 48 and pivotally secured at another end, through pivot pins 68, to a guide roller assembly cross member 70. The pivotable roller housings 66 each can rotate about pivot pins 68 together with wheels 48 to adjust the angular disposition of wheels 48 with respect to the exterior surface of conduit 12 to fix the amount of longitudinal travel of frame member 14 along conduit 12 per helical revolution of travel of frame member 14 and thereby fix the amount of sheet material overlap.

In accordance with an important feature of the present invention, both rollers 48 and both roller housings 66 of guide roller angular adjustment assembly 30 are simultaneously adjusted to the same angle with respect to the longitudinal axis of conduit 12 by turning a calibrated star wheel assembly, generally designated by numeral 72. The calibrated star wheel assembly 72 includes a threaded cross member 74 fixedly secured to a star wheel 76 and threadedly connected to L-shaped, pivotable cross members 78 of wheel housings 66 through threaded nuts 80, welded to wheel housing cross members 78 as shown in FIG. 3. By turning star wheel 76, the threaded cross member 74 simultaneously pulls one wheel housing cross member 78 toward star wheel 76 and pushes the other wheel housing cross member 78 away from star wheel 76 to the same degree. The wheel housing cross members 78 are pivotally attached to the roller housings 66 by pivot pins 82 and cross members 84 so that movement of wheel housing cross members 78 causes the wheel housings 66 to rotate about pivot pins 68 to change the angular disposition of wheels 48 with respect to conduit 12. The star wheel 76 includes a star wheel extension member 86 secured to the star wheel 76 and having spaced indication or calibration lines, as shown in FIG. 3, so that the angular disposition of wheels 48 with respect to the conduit 12 can be predetermined by turning star wheel 76 until a predetermined calibration line on star wheel extension member 86 is aligned with an indication line disposed on a fixed, frame attached calibration member 87.

Figure 5:
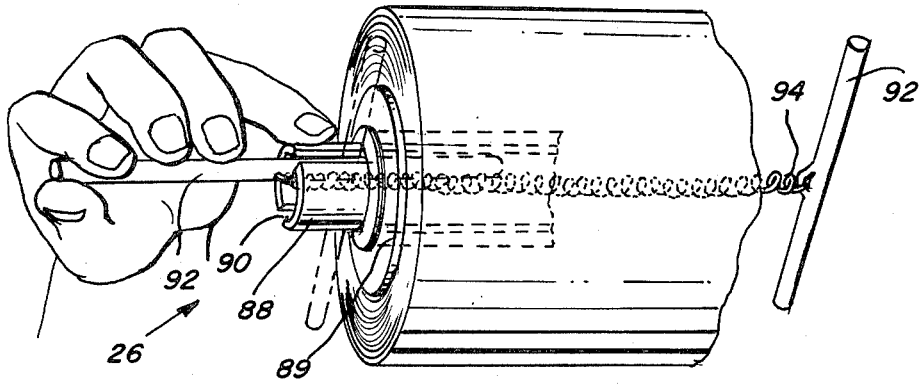
FIG. 5 is a partially broken-away, perspective view of a portion of the sheet material feeding assembly constructed in accordance with the principles of the present invention.

In accordance with another important feature of the present invention, the sheet material feeding assembly 26 includes a simple and effective mechanism for releasably maintaining a roll of sheet material 85 on a material feed reel 88, as best shown in FIG. 5. The sheet material feed reel 88 comprises an elongated tube of sufficiently small diameter to be inserted through a central elongated aperture 89 in the roll of sheet material without substantial frictional engagement thereagainst, as shown in FIG. 5. The feed reel 88 includes an elongated slot 90 at one end for receiving one of the sheet material roll retaining bars 92 spring biased to the other retaining bar 92 by elongated spring 94. With a sheet material roll in position over sheet material feed reel 88, as shown in FIG. 5, one of the tape reel retaining bars 92 is inserted within the slot 90, as shown in dashed lines, and the retaining bar 92 is held within the slot 90 by the spring 94 to prevent the tape roll from sliding off of the feed reel 88. To remove an empty tape roll and to position a new tape roll over the feed reel 88, the retaining bar 92 can be removed from the slot 90 and at least partially inserted within the material feed reel, as shown in solid lines in FIG. 5, so that a new tape roll can be positioned over the feed reel 88. The retaining bar 92 then can be reinserted within slot 90 as shown in dashed lines FIG. 5.

Figure 8:
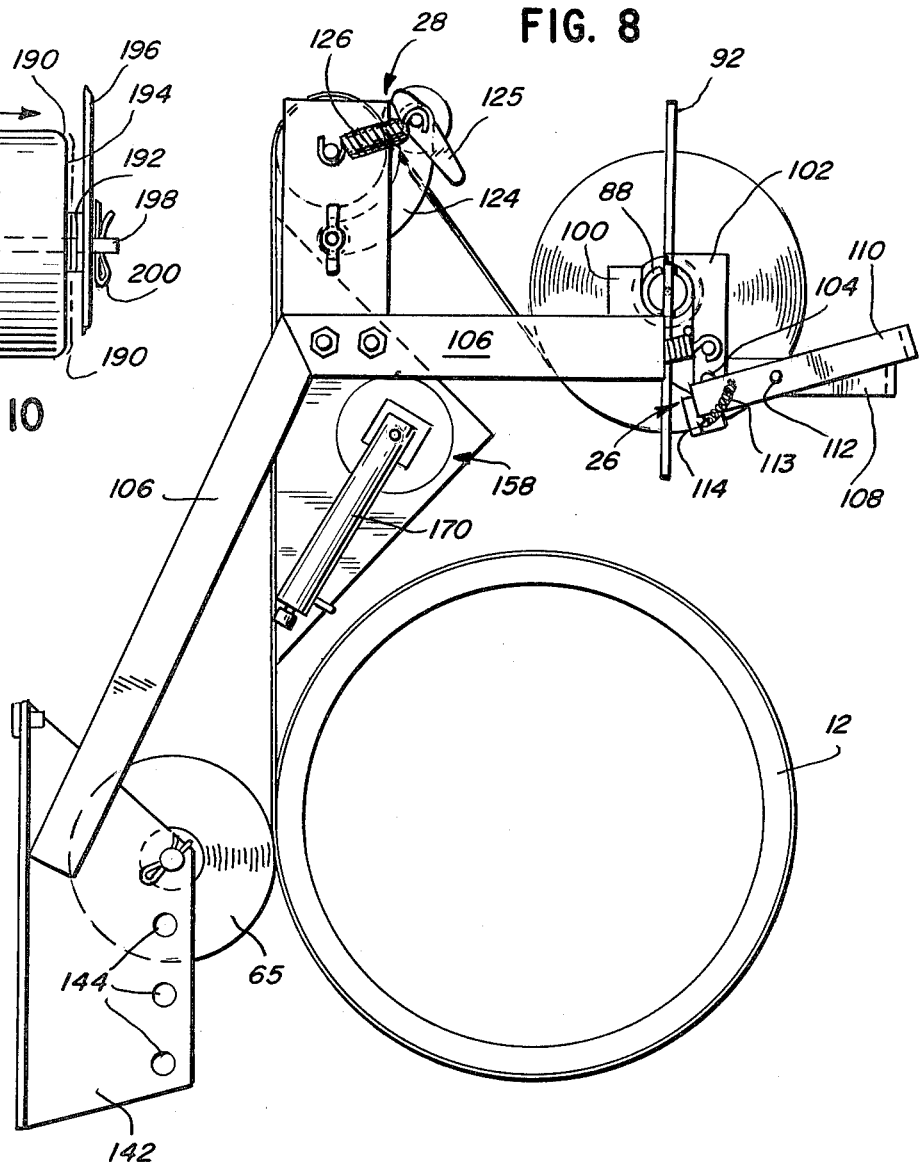
FIG. 8 is a partially elevational, side view of a sheet material feeding assembly, a sheet material tensioning assembly, and a sheet material applying pressure roller shown interconnected through a common frame member to achieve simultaneous and identical angular deflection of both assemblies.
Figure 9:
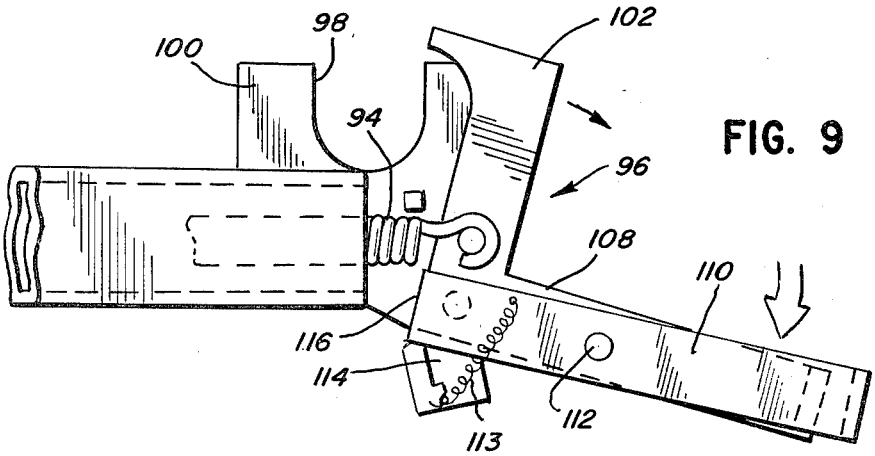
FIG. 9 is a partially broken-away, partially elevational view of the tape reel locking mechanism constructed in accordance with the principles of the present invention.

In accordance with another important feature of the present invention the sheet material feeding assembly 26 also includes feed reel locking assembly 96, as shown in FIGS. 4 and 9, to prevent the feed reel 88 from falling out of the feeding assembly as the apparatus is rotated around a conduit. As shown in FIGS. 4, 6 and 9, the sheet material feed reel 88 is positioned for tape feeding by disposing one end of the feed reel 88 within an aperture 97 in feed reel locking assembly frame member 99 and by disposing the opposite end of the material feed reel 88 within U-shaped slot 98 in a frame portion 100 of feed reel locking assembly 96. As shown in FIGS. 8 and 9, the sheet material feeding assembly 26 includes a reel locking cross member 102 pivotable about pivot pin 104 across the mouth of the U-shaped slot 98 to secure the reel 88 in position, and pivotable about pivot pin 104 away from the mouth of U-shaped slot 98 for removal of the feed reel 88.

The reel locking cross member 102 is spring biased to a feeding assembly frame member 106 to releasably maintain the reel locking cross member 102 over the mouth of U-shaped slot 98, as shown in FIG. 8. As shown in FIGS. 4, 8 and 9, the reel locking cross member 102 includes a U-shaped elongated handle 108 perpendicularly secured to cross member 102 for manually rotating the reel locking cross member 102 both across and away from the feed reel receiving U-shaped slot 98.

In accordance with another important feature of the present invention, the feed reel locking assembly 96 includes a quickly releasable U-shaped locking mechanism 110. The locking mechanism 110 has an off-centered pivot pin 112 pivotally extending through U-shaped handle 108 and spring biased through coil spring 113 to an L-shaped locking assembly stop member 114 for locking the cross-member 102 in secured position across the mouth of U-shaped slot 98, as shown in FIG. 8. With the reel locking cross member 102 in position over the mouth of U-shaped slot 98, as shown in FIG. 8, the locking mechanism 110 can be rotated about pivot pin 112 from its position shown in FIG. 9 to its position shown in FIG. 8 to secure a stop contacting end 116 of locking mechanism 110 against the L-shaped stop member 114, as shown in FIG. 8, to lock the cross member 102 across the mouth of U-shaped slot 98.

Figure 11:
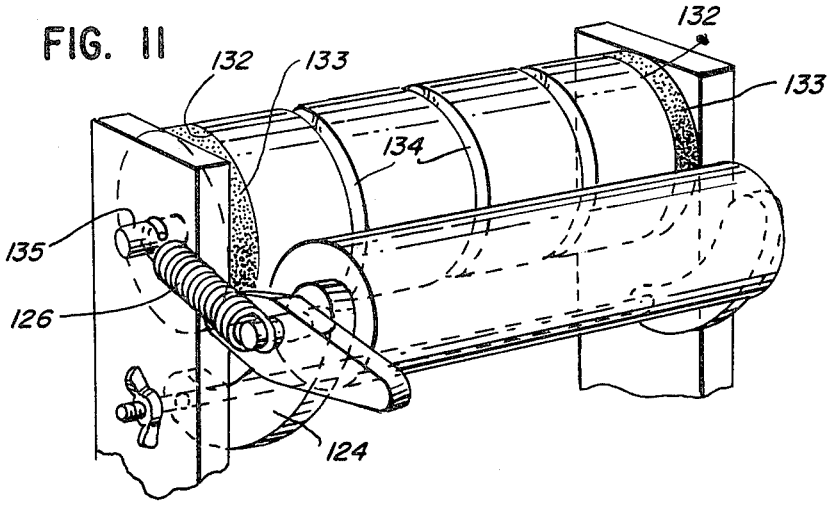
FIG. 11 is a partially broken-away perspective view of the sheet material tensioning assembly forming part of the tape feeding assembly and constructed in accordance with the principles of the present invention.

In accordance with another important feature of the present invention the sheet material is fed from the sheet material feeding assembly 26 to the sheet material tensioning assembly 28 so that sheet material conveyed to the outer surface of conduit 12 is under a constant amount of tension so that the sheet material 85 is very difficultly removed from the surface of conduit 12. The sheet material tensioning assembly 28, best shown in FIG. 11, generally comprises a pair of rotatable rollers 118 and 120 rotatable about frame members 122 and 124, respectively, and spring biased toward one another by coil spring 126 to form a sheet material receiving pressure nip 128 between rollers 118 and 120. As shown in FIG. 11, the frame members 124 carrying the rotatable roller 120 are pivotable about pivot pin 130 so that the roller 120 can be forced, against the spring bias of spring 120, away from roller 118 to initially insert the tape material between rollers 118 and 120.

In accordance with another important feature of the present invention, flat end surfaces 132 of roller 118 are adjustably frictionally engaged against a suitable disc brake type material 133 disposed between the end surfaces 132 of roller 118 and inner surfaces of the frame members 122. The frictional engagement of the roller 118 against the disc material 133 makes the roller 118 adjustably difficultly rotatable about central axis 135 so that a predetermined amount of tension can be applied to the sheet material 85 between the pressure nip 128 and the sheet material applying pressure roller 65. Roller 118 is provided with an elastomeric outer surface having a plurality of grooves 134 therein for better frictional engagement against the sheet material so that sufficient frictional engagement can be provided between the end surfaces 132 of roller 118 and the disc material 133 without the sheet material 85 slipping between the nip 128. The amount of frictional engagement between the end surfaces 132 of roller 118 and the disc material 133 is adjustable by providing a threaded cross member 136 spanning frame members 122 so that by turning wing nut 138, the distance of separation of frame members 122 is adjusted to increase or decrease the amount of frictional engagement between roller end surfaces 132 and the disc material 133.

In accordance with another important feature of the present invention, the sheet material feeding assembly 26, the sheet material tensioning assembly 128 and the guide roller assembly 18 are all interconnected through a common feeding assembly frame member 106, as shown in FIGS. 6 and 8, so that any change made to the angular disposition of guide roller assembly 18 with respect to the conduit 12 identically changes the angular disposition of sheet material feeding assembly 26 and sheet material tensioning assembly 28. In accordance with one embodiment of the present invention, it is important to maintain an identical angular disposition of material feeding assembly 26, sheet material tensioning assembly 28 and the enlarged tape securing pressure roller 65 of guide roller assembly 18 so that the sheet material is not stretched or compressed unevenly across its width as the sheet material is fed to the outer surface of conduit 12. Differences in angular disposition between material feeding assembly 26, material tensioning assembly 28 and tape securing pressure roller 65 will cause the sheet material 65 to be stretched particularly along an outer edge so that the stretched edge cannot maintain complete adhesive contact against the surface of the conduit 12.

The guide roller assembly 18, including tape securing pressure roller 65 and guide roller 44 (FIG. 2), is adjustably angularly disposed with respect to the conduit 12 by a guide roller angular adjustment assembly constructed the same as the guide roller angular adjustment assembly 30 shown in FIG. 3. The tape securing pressure roller 65 of guide roller assembly 18 includes an additional enlarged, U-shaped wheel housing frame member 142, best shown in FIG. 6, for adjustable attachment of the feeding assembly frame members 106 thereto so that any angular change in guide roller assembly 18 causes a corresponding angular change in the sheet material feeding assembly 26 and in the sheet material tensioning assembly 28, as shown in FIGS. 6 and 8. As shown in FIG. 8, the wheel housing frame member 142 of tape securing pressure roller 65 includes a number of spaced apertures 144, similar to the wheel housing 66 of guide roller assemblies 20 and 22, for adjusting the disposition of pressure roller 65 with respect to the conduit 12 to accommodate various diameter conduits.

In accordance with another very important and unique feature of the present invention, as best shown in FIG. 4, the apparatus of the present invention includes a tape backing material take-off assembly, generally designated by numeral 32. Cold-applied tape generally includes a backing material 146 (FIG. 4) which covers an adhesive coated side of the tape 85 to prevent successive layers of the tape from sticking together when in roll form and to preserve the adhesive. When the cold-applied tape is wrapped around a conduit, it has been the practice to merely strip away and dispose of the backing material 146. Adhesive tape backing materials 146 are made of a suitable smooth material having substantial lubricity, such as polyethylene, and these materials sometimes include a release coating such as a silicone or fluorocarbon on the adhesive contacting surface so that the backing material easily can be stripped away from the adhesive coated side of the tape.

In accordance with an important feature of the present invention, it has been found that the backing material is very useful as an additional protective overcoating when wound around the outer surface of the applied tape. The application of the backing material 146 as an overcoating applied over the tape is accomplished with the backing material take-off assembly 32 which generally comprises a parallelogram shape frame assembly including backing material contacting parallel guide bars 148 and 150 for stripping the backing material 146 away from the tape, spacing the backing material from the tape being applied so that the backing material is not caught between successive layers of the applied tape, and wrapping the backing material 146 as an overcoating over the applied tape at a point at least one frame member revolution behind the point of tape application. In accordance with an important feature of the present invention, the backing material contacting guide bars 148 and 150 are spaced at least the width of the tape material so that the backing material 146 does not get caught between successively applied tape layers. The backing material 146 is applied with the release coated or adhesive contacting side on its outer surface, as shown in FIG. 4. It has been found that the overcoating of the tape backing material 146 protects the applied tape as the pipe is being installed and provides a slippery outer surface so that the applied layers are less easily abraded. Further, because the backing materials 146 are generally of a light color, such as white, and many of the cold applied tapes are darkly colored, generally black because of their bituminous base, the top coating of backing material 146 gives a distinct advantage in reflecting heat from the surface of the conduit 12 so that the conduit 12 can be more easily handled when it is installed in its desired location.

It has been found that the backing material 146 will stick to the outer surface of the tape material and is tightly secured thereto because some of the adhesive material from successively applied tape layers 85 is forced outwardly by the pressure roller 65 and guide rollers 44, 46 and 48 to secure the backing material thereto, because sometimes the backing materials 146 are statically charged, when removed from the tape 85, and because the backing material 146 is tightly wound against the exterior tape surfaces as a result of the tension applied guide rollers assemblies 18, 20 and 22.

Further, when the tape 85 is cut after the entire conduit 12 has been wrapped, the cut ends of the backing material 146 can be secured to the outer tape surface with additional adhesive or other securing means to maintain the backing material 146 securely and tightly over the applied tape 85 along the entire length of the conduit 12. The backing material contacting guide bars 148 and 150 of backing material take-off assembly 32 are maintained in spaced relation by being secured to cross support bars 152 and 154 and the backing material take-off and wrapping assembly 32 is secured to the material feeding assembly frame members 106 by brackets 156 so that any angular movement of guide roller assembly 18, sheet material feeding assembly 26, and sheet material tensioning assembly 28 correspondingly changes the angular disposition of the backing material take off and wrapping assembly 32 with respect to the conduit 12. In this manner, as described with reference to the tape material 85, the backing material 146 is not stretched along either edge so that it can be strongly and tightly secured over the tape material 85 along the entire length of conduit 12.

Figure 7:
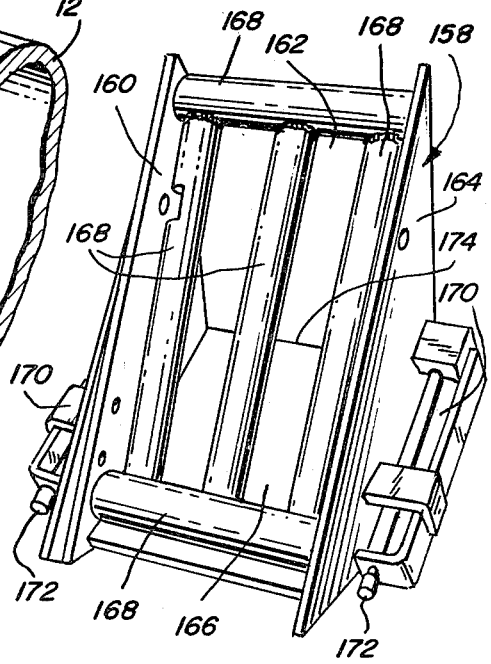
FIG. 7 is a perspective view of a tape heating burner assembly constructed in accordance with the principles of the present invention.

In accordance with another important feature of the present invention, as shown in FIGS. 7 and 8 the heater assembly 158 is disposed between the sheet material tensioning assembly 28 and the tape securing pressure roller 65 to adhesively soften an interior surface of a hot-applied tape so that the tape will be tightly adhesively secured to the conduit 12 by pressure applied from tape-applying pressure roller 65. The heater assembly 158 is secured to the feeding assembly frame members 106 so that any angular adjustment of material feeding assembly 26 and material tensioning assembly 28 will cause the same angular adjustment to heater assembly 158 to assure that the inner surface of the tape material is adhesively softened across its entire width for proper and strong attachment to the outer surface of conduit 12. The heater assembly 158, as shown in FIG. 7, generally includes sheet metal frame members 160, 162, 164, and 166 welded together to form an elongated triangular enclosure having a generally open base and includes a plurality of heat conducting metal tubes 168 for evenly distributing heat across the tape facing open base of the triangular enclosure. Burner assemblies 170 are attached to both sides and form part of heater assembly 158, as shown in FIG. 7, and are connected to conduits 172 for conveying a flammable fluid, such as propane, to the burner assemblies 170. The burner assemblies 170 direct flames along an apex 174 within the interior of the heater assembly 158 so that an interior surface of the tape is adhesively softened prior to contacting an exterior surface of the conduit 12, without impinging the flame directly against the tape material.

Figure 13:
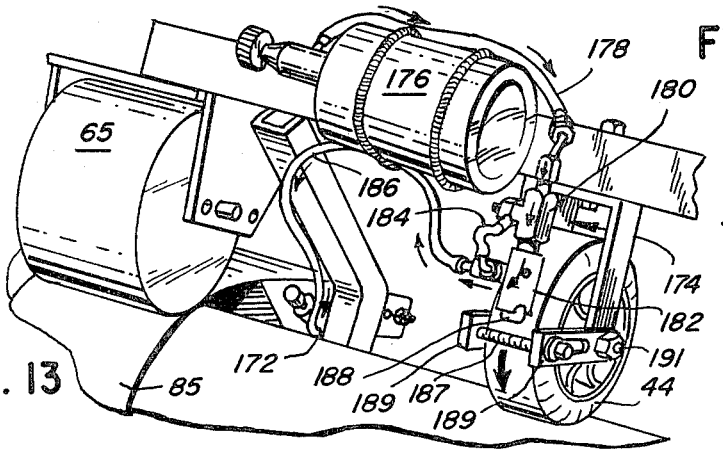
FIG. 13 is a partially broken-away, perspective view of a flammable fluid metering assembly actuatably connected through a braking mechanism to a frame connected guide roller shown before guide roller rotation with the burner valve in an off position.
Figure 13A:
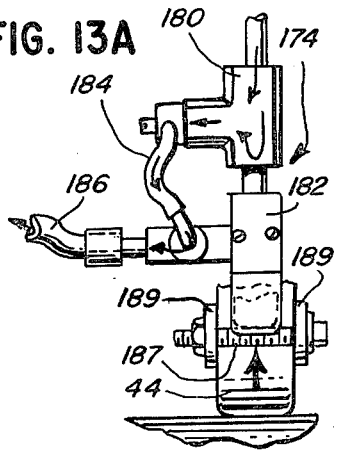
FIG. 13A is a partially broken-away, partially elevational end view of a portion of the flammable fluid metering assembly of FIG. 13 shown during a sheet material wrapping with the burner valve in an on position.

The flammable fluid conduits 172 of burner assemblies 170 are suitably connected to a source of flammable fluid through a new and important flammable fluid metering valve assembly, shown in FIGS. 13 and 13A and generally designated by numeral 174.

In accordance with an important feature of the present invention, a flammable fluid, such as propane in tank 176, is fluid connected through conduit 178 to a pilot valve 180 and a separately operable burner valve 182. The pilot valve 180 circumvents the burner valve 182 through fluid cross conduit 184 for constant metering of sufficient propane from tank 176 to conduit 186, which is connected to the flammable fluid conduits 172 shown in FIG. 7, so that a constant, small amount of propane is fed to burner assemblies 170 regardless of the operation of burner valve 182.

In accordance with another important feature of the present invention, the burner valve 182 is actuated by a guide roller extending, threaded across member 187 (FIG. 13A) by contact of the cross member 187 against valve actuating lever 188 whenever the guide roller 44 is rotated around the conduit 12 in the proper direction for tape wrapping. The cross member 187 moves upwardly to actuate the burner valve 182 when the guide roller 44 is properly rotated because the cross member 187 squeezes rotatable guide roller engagement frame members 189 against the guide roller 44 to cause the cross member 187 and frame members 189 to pivot upwardly about the guide wheel axis 191 until the actuating lever 188 is fully compressed thereby permitting flammable fluid to be conveyed along conduits 186 and 172 to the burner assemblies 170. Opposite rotation of guide roller 44 forces the cross member 187 and frame members 189 downwardly as shown in FIG. 13 until a frame member contacts a frame connected stop member (not shown) to close burner valve 182.

In accordance with another important feature of the present invention, the tape securing pressure roller 65 includes beveled edges 190 (FIG. 10) so that no portion of pressure roller 65 contacts an outer surface of conduit 12 without an intermediate, aligned layer of tape 85 therebetween. The outer surface of conduit 12 is carefully cleaned and treated prior to tape winding to make sure that the applied tape adheres to the outer surface of the conduit 12. Contact of pressure roller 65 against a cleaned surface of conduit 12 would contaminate the outer conduit surface, sometimes causing non-adherence of the tape material 85.

Figure 10:
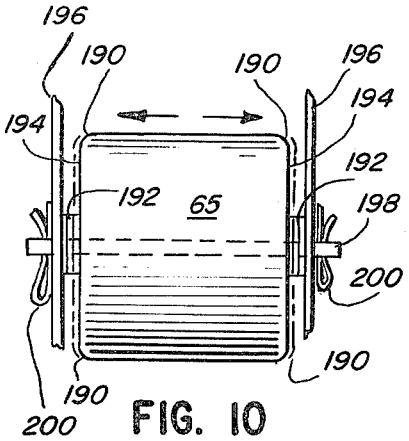
FIG. 10 is a partially broken-away, partially elevational view of the tape applying pressure roller constructed in accordance with the principles of the present invention.

The pressure roller 65 can be adjusted longitudinally with respect to the conduit 12 by inserting pressure roller positioning washers 192 between end surfaces 194 of pressure roller 65 and pressure roller frame members 196, as shown in FIG. 10. The pressure roller 65 revolves around a central axis 198 journalled through frame members 196 and the axis of rotation 198 can be removed quickly and easily by removing one of the quick release pins 200 so that the washers 192 can be inserted over the central axis 198 on either side of pressure roller 65.

What is claimed and desired to be secured by Letters Patent is:

1. Apparatus for wrapping an elongated conduit helically with sheet material comprising:

a frame assembly adapted to circumscribe a portion of a conduit including a plurality of sheet material contacting support members extending inwardly therefrom in a rotatable but non-resilient manner and including a fixed frame portion and a rotatable frame portion;

means for retaining said conduit within said frame assembly while said frame assembly is rotated around said conduit during wrapping of said sheet material on said conduit;

an adjustable frame member disposed in chordal relation to said frame assembly to connect said fixed frame portion to said rotatable frame portion, said adjustable frame member including means to adjust a length of said adjustable frame member to secure said rotatable frame portion to said fixed frame portion without completely circumscribing said conduit;

means for feeding a strip of said sheet material against an outer surface of said conduit; and means for pressing said strip of sheet material against said outer surface to adhere said strip of sheet material to said outer conduit surface.

2. Apparatus as defined in claim 1 wherein a plurality of said sheet material contacting support members are biased toward said conduit and further including means for adjusting the amount of biasing force applied to said conduit by said support members.

3. Apparatus as defined in claim 1 further including means for adjusting an amount of longitudinal travel of said apparatus along said conduit per revolution of said apparatus around said conduit.

4. Apparatus as defined in claim 3 wherein said means for adjusting the longitudinal travel of said apparatus includes means for adjusting the angle of said support members with respect to said conduit.

5. Apparatus as defined in claim 1 further including a locking assembly for releasably locking said strip feeding means to said frame assembly.

6. Apparatus as defined in claim 1 wherein said sheet material feeding means includes an elongated member adapted to be inserted through a central aperture in a roll of said sheet material to extend beyond said sheet roll on both sides of said sheet roll, said elongated member having an elongated slot at one end thereof, and a sheet material roll retaining bar adapted to fit releasably within said slot to retain said sheet roll on said elongated member when said retaining bar is inserted into said slot.

7. Apparatus as defined in claim 5 wherein said locking assembly includes a frame member having means defining a slot adapted to receive said sheet material feeding means, and a pivotable cross member adapted to pivot in a first position over said slot means to lock said sheet material feeding means within said slot, and a second position substantially not obstructing said slot means so that said sheet material feeding means can be inserted into and removed from said slot.

8. Apparatus as defined in claim 7 wherein said pivotable cross member is spring baised to a frame member to releasably maintain said cross member over said slot.

9. Apparatus as defined in claim 7 further including a quickly releasable locking means to lock said cross member in a position over said slot.

10. Apparatus as defined in claim 1 further including a burner assembly adapted to heat a conduit contacting side of said sheet material strip continuously by direct impingement of said strip with hot gases as said strip is continuously applied to an outer surface of said conduit.

11. Apparatus as defined in claim 1 further including means for removing a backing material from said sheet material before said sheet material is adhered to said outer conduit surface.

12. Apparatus as defined in claim 11 wherein said backing material removing means includes a frame member adapted to strip said backing material from said sheet material as said apparatus is rotated around said conduit.

13. Apparatus for wrapping an elongated conduit helically with sheet material applied with consistent tension and a predetermined amount of sheet material overlap comprising:

a frame member including a fixed frame portion and a rotatable frame portion, said frame member including means to dispose said rotatable portion of said frame in an open position adapted for initially disposing said apparatus around a conduit and means for disposing said rotatable frame portion in a closed position for fixedly securing said apparatus against said conduit under a desired and adjustable degree of tension in a non-resilient but rotatable manner;

means for rotating said rotatable portion of said frame member in a direction away from said conduit to permit said apparatus to be positioned around said conduit with said conduit generally centrally disposed within said frame member;

means for rotating said rotatable portion of said frame member in a direction toward said conduit to secure said conduit within said frame member;

an adjustable frame member disposed in chordal relation to said frame assembly to connect said fixed frame portion to said rotatable frame portion, said adjustable frame member including means to adjust a length of said adjustable frame member to secure said rotatable frame portion to said fixed frame portion without completely circumscribing said conduit;

means for feeding a strip of said sheet material against an outer surface of said conduit;

means for pressing said strip of sheet material against said outer surface to adhere said strip of sheet material to said outer conduit surface.

14. Apparatus for wrapping an elongated conduit helically with sheet material comprising:

a frame assembly adapted to circumscribe a portion of a conduit;

means for retaining said conduit within said frame assembly while said frame assembly is rotated around said conduit during wrapping of said sheet material on said conduit;

means for feeding a strip of said sheet material against an outer surface of said conduit;

means for pressing said strip of sheet material against said outer surface to adhere said strip of sheet material to said outer conduit surface; and a burner assembly adapted to heat a conduit contacting side of said sheet material strip continuously as said strip is continuously applied to an outer surface of said conduit, said burner assembly including means for actuating said burner assembly when said frame assembly is rotated about said conduit in a tape wrapping rotational direction and means for preventing actuation of said burner assembly when said frame assembly is rotated about said conduit in a non-tape applying rotational direction.

15. Apparatus as defined in claim 14 wherein said burner assembly actuating means includes a wheel-contacting frame member such that wheel rotation in a tape wrapping direction causes said wheel-contacting frame member to move toward a fluid valve to actuate said fluid valve and deliver a flammable fluid to said burner assembly, and such that wheel rotation in a non-tape wrapping direction causes said frame member to move away from said fluid valve to de-actuate said valve.

16. Apparatus as defined in claim 15 further including a flammable fluid pilot conduit by-passing said fluid valve and interconnected to said burner assembly to maintain a pilot flame to said burner assembly.

17. Apparatus for wrapping an elongated conduit helically with sheet material comprising:

a frame assembly adapted to circumscribe a portion of a conduit, including a plurality of sheet material contacting support members extending inwardly therefrom in a rotatable manner;

an adjustable frame member disposed in chordal relation to said frame assembly to connect said fixed frame portion to said rotatable frame portion, said adjustable frame member including means to adjust a length of said adjustable frame member to secure said rotatable frame portion to said fixed frame portion without completely circumscribing said conduit;

means for feeding a strip of said sheet material against an outer surface of said conduit;

means for pressing said strip of sheet material against said outer surface to adhere said strip of sheet material to said outer conduit surface; and means for adjusting the angle of said support members with respect to said conduit.

18. Apparatus as defined in claim 17 further including means for removing a backing material from said sheet material before said sheet material is adhered to said outer conduit surface.

19. Apparatus as defined in claim 18 wherein said backing material removing means includes a frame member adapted to strip said backing material from said sheet material as said apparatus is rotated around said conduit.

20. Apparatus as defined in claim 17 wherein said backing material removing means comprises a parallelogram.

21. Apparatus for wrapping an elongated conduit helically with sheet material comprising:

a frame assembly adapted to circumscribe a portion of a conduit, including a plurality of sheet material contacting support members extending inwardly therefrom in a rotatable manner;

means for retaining said conduit within said frame assembly while said frame assembly is rotated around said conduit during wrapping of said sheet material on said conduit;

means for feeding a strip of said sheet material against an outer surface of said conduit;

means for pressing said strip of sheet material against said outer surface of said conduit to adhere said strip of sheet material to said outer conduit surface;

means for removing a backing material from said sheet material before said sheet material is adhered to said outer conduit surface including a frame member adapted to strip said backing material from said sheet material and wrap said backing material over said sheet material as said apparatus is rotated around said conduit; and means for adjusting the angle of said support members with respect to said conduit.

22. Apparatus as defined in claim 21 wherein said backing material stripping frame member includes means for spacing said backing material at least one sheet material width behind said sheet material as both sheet material and backing material are wrapped to prevent said backing material from being over wrapped between successive layers of sheet material.

23. Apparatus for wrapping an elongated conduit helically with sheet material comprising:

a frame assembly adapted to circumscribe a portion of a conduit;

means for retaining said conduit within said frame assembly while said frame assembly is rotated around said conduit during wrapping of said sheet material on said conduit;

means for feeding a strip of said sheet material against an outer surface of said conduit;

means for pressing said strip of sheet material against said outer surface to adhere said strip of sheet material to said outer conduit surface; and means for removing a backing material from said sheet material including means for wrapping said backing material over said sheet material as said apparatus is rotated around said conduit.

24. Apparatus as defined in claim 23 wherein said backing material removing means includes means for spacing said backing material at least one sheet material width behind said sheet material as both sheet material and backing material are wrapped to prevent said backing material from being over wrapped between successive layers of sheet material.

25. Apparatus as defined in claim 23 wherein said backing material removing means comprises parallel frame end members angled with respect to said sheet material and disposed at a position between said sheet material feeding means and said conduit, said frame end members adapted to remove said backing material from said sheet material and apply said backing material over said sheet material at the same time as said sheet material is applied but at a spaced location from said sheet material, such that the side of the backing material which contacts the sheet material before backing material removal, faces outwardly when wrapped over the sheet material on the conduit.

26. Apparatus for wrapping an elongated conduit helically with sheet material comprising:

a frame assembly adapted to circumscribe a portion of a conduit including a plurality of sheet material contacting support members extending inwardly therefrom in a rotatable but non-resilient manner;

means for retaining said conduit within said frame assembly while said frame assembly is rotated around said conduit without completely circumscribing said conduit with said frame assembly;

means for adjusting an amount of longitudinal travel of said apparatus along said conduit per revolution of said apparatus around said conduit;

means for identically adjusting the rotational angle of said strip material feeding assembly and said support members with respect to said conduit said strip material feeding assembly being connected to said support member angle adjustment means; and means for feeding a strip of said sheet material against an outer surface of said conduit, means for pressing said strip of sheet material against said outer surface to adhere said strip of sheet material to said outer conduit surface.

27. Apparatus for wrapping an elongated conduit helically with sheet material comprising:

a frame assembly adapted to circumscribe a portion of a conduit including a plurality of sheet material contacting support members extending inwardly therefrom in a rotatable but non-resilient manner;

means for retaining said conduit within said frame assembly while said frame assembly is rotated around said conduit during wrapping of said sheet material on said conduit without completely circumscribing said conduit with said frame assembly;

means for feeding a strip of said sheet material against an outer surface of said conduit;

an adjustable sheet material tensioning assembly comprising a roller nip including means for frictionally engaging a roller of said roller nip to provide a predetermined amount of tension to said strip material between said sheet material tensioning assembly and said conduit; and means for pressing said strip of sheet material against said outer surface of said conduit to adhere said strip of sheet material to said outer conduit surface.

28. Apparatus for wrapping an elongated conduit helically with sheet material comprising:

a frame assembly adapted to circumscribe a portion of a conduit, including a plurality of sheet material contacting support members extending inwardly therefrom in a rotatable manner;

means for retaining said conduit within said frame assembly while said frame assembly is rotated around said conduit during wrapping of said sheet material on said conduit;

means for feeding a strip of said sheet material against an outer surface of said conduit;

means for pressing said strip of sheet material against said outer surface to adhere said strip of sheet material to said outer conduit surface;

an adjustable sheet material tensioning assembly comprising a sheet material pressure nip including an adjustable pressure roller breaking assembly for adjusting the desired amount of sheet material tension; and means for adjusting the angle of said support members with respect to said conduit.

29. Apparatus for wrapping an elongated conduit helically with sheet material comprising:

a frame assembly adapted to circumscribe a portion of a conduit including a plurality of sheet material contacting support members extending inwardly therefrom in a rotatable but non-resilient manner;

means for retaining said conduit within said frame assembly while said frame assembly is rotated around said conduit during wrapping of said sheet material on said conduit without completely circumscribing said conduit with said frame assembly;

means for feeding a strip of said sheet material against an outer surface of said conduit;

means for removing a backing material from said sheet material before said sheet material is adhered to said outer conduit surface, said backing material removing means including a frame member adapted to strip said backing material from said sheet material as said apparatus is rotated around said conduit, said backing material stripping frame member including means for wrapping said backing material over said sheet material as said apparatus is rotated around said conduit; and means for pressing said strip of sheet material against said outer surface of said conduit to adhere said strip of sheet material to said outer conduit surface.

30. Apparatus as defined in claim 29 wherein said backing material stripping frame member includes means for spacing said backing material at least one sheet material width behind said sheet material as both sheet material and backing material are wrapped to prevent said backing material from being over wrapped between successive layers of sheet material.

31. Apparatus as defined in claim 29 wherein said backing material stripping frame member comprises parallel frame end members angled with respect to said sheet material and disposed at a position between said sheet material feeding means and said conduit, said frame end members adapted to remove said backing material from said sheet material and apply said backing material over said sheet material at the same time as said sheet material is applied but at a spaced location from said sheet material.

32. Apparatus as defined in claim 31 wherein said backing material stripping frame member comprises a parallelogram.

33. Apparatus for wrapping an elongated conduit helically with sheet material comprising:

a frame assembly adapted to circumscribe a portion of a conduit including a plurality of sheet material contacting support members extending inwardly therefrom in a rotatable but non-resilient manner;

means for retaining said conduit within said frame assembly while said frame assembly is rotated around said conduit during wrapping of said sheet material on said conduit without completely circumscribing said conduit with said frame assembly;

a strip material feeding assembly for feeding a strip of said sheet material against an outer surface of said conduit, said strip material feeding assembly being connected to said support members through a means for adjusting the angle of said support members with respect to said conduit, so that angular adjustment of said support members causes simultaneous angular adjustment of said strip material feeding assembly; and means for pressing said strip of sheet material against said outer surface to adhere said strip of sheet material to said outer conduit surface.

34. Apparatus for wrapping an elongated conduit helically with sheet material comprising:

a frame assembly adapted to circumscribe a portion of a conduit, including a plurality of sheet material contacting support members extending inwardly therefrom in a rotatable manner;

means for retaining said conduit within said frame assembly while said frame assembly is rotated around said conduit during wrapping of said sheet material on said conduit;

means for feeding a strip of said sheet material against an outer surface of said conduit;

means for pressing said strip of sheet material against said outer surface of said conduit to adhere said strip of sheet material to said outer conduit surface; and means for identically adjusting the rotational angle of said strip material feeding assembly and said support members with respect to said conduit.

35. Apparatus as defined in claim 21 wherein said backing material stripping frame member comprises parallel frame end members angled with respect to said sheet material and disposed at a position between said sheet material feeding means and said conduit, said frame end members adapted to remove said backing material from said sheet material and apply said backing material at the same time as said sheet material is applied but at a spaced location from said sheet material.

36. Apparatus as defined in claim 35 wherein said backing material stripping frame member comprises a parallelogram.

* * * * *